United States Patent [19]

Desanta

[11] Patent Number: 5,037,116

[45] Date of Patent: Aug. 6, 1991

[54] FOLDABLE CHAIR

[76] Inventor: Simon Desanta, Hollen, Im Lohden, D-4830 Guetersloh 12, Fed. Rep. of Germany

[21] Appl. No.: 417,777

[22] Filed: Oct. 6, 1989

[30] Foreign Application Priority Data

Oct. 21, 1988 [DE] Fed. Rep. of Germany ..... 3835855

[51] Int. Cl.[5] ..... A47C 4/00

[52] U.S. Cl. ..... 297/39; 297/16; 297/239

[58] Field of Search ..... 297/16, 35, 39, 239; 248/166, 168, 169

[56] References Cited

U.S. PATENT DOCUMENTS 2,874,755 2/1959 Smith ..... 297/239 X 4,529,245 7/1985 Kassai ..... 297/35 X

FOREIGN PATENT DOCUMENTS 292531 1/1932 Italy ..... 297/39

*Primary Examiner*—Peter R. Brown

*Attorney, Agent, or Firm*—Spencer & Frank

[57] ABSTRACT

A folding chair includes two front legs (10, 12) which are rigidly connected at their lower ends with rearwardly oriented supporting arms (14, 16). Arm rests (24, 26) are pivotally connected with the upper ends of the legs (10, 12), and a seat plate (18) is pivotally attached at a lower point of the legs. The rear ends of the seat plate (18) and of the arm rests (24, 26) are connected by means of struts (38, 40) which are articulated on both sides. The upper ends of the legs (10, 12), the arm rests (24, 26), the rear struts (38, 40) and the seat plate (18) form a parallelogram assembly on either side of the chair so as to make it possible to fold the folding chair together into an essentially vertical position by raising the back rest. Stops (22) limit the pivoting movement of the four-bar mechanism in the seating position of the chair.

9 Claims, 3 Drawing Sheets

FOLDABLE CHAIR

BACKGROUND OF THE INVENTION

The invention relates to a folding chair including a seat plate supported by legs, a back rest and arm rests.

Folding chairs can be stacked in a space-saving manner so that they are available, in particular, as seats that are utilized only from time to time and which, after use, can be stored at a suitable location without requiring an excess amount of space. An important field of use for folding chairs is the equipping with chairs of multi-purpose rooms or halls in which the type and number of chairs employed may change from one event to the next. Since in this case possibly a large number of chairs must be stored in an adjacent room, it is not only important that the chairs can be stored in the most space saving manner but also that the chairs can be transported as easily as possible from their location of use to the storage area and back.

This problem is not considered in the design of conventional folding chairs. Although they can be stacked in their folded state and can be carried away as a stack, such a stack has only poor stability and larger stacks have a considerable weight. To facilitate such work, it may therefore be necessary to make available a special carriage.

SUMMARY OF THE INVENTION

It is the object of the invention to provide a folding chair which, in the folded state, can be placed together with identical chairs in a particularly space-saving manner and is easy to transport.

This is accomplished by the invention in that only two front legs are provided which are rigidly connected at their lower ends with rearwardly oriented supporting arms; that arm rests are connected with the upper ends of the legs and a seat plate is pivotally connected with the legs at a lower point; the arm rests and the seat plate are connected with one another at the rear by braces which are pivotally articulated on both sides; and, in the seating position, the pivoting movement of the parallelogram rod assembly formed by the legs, the arm rests, the bars and the seat plate is limited by stops.

If the folding chair according to the invention is to be folded, it is merely necessary that its back rest be pulled up. Thus, the seat plate, the arm rests and the rear braces attain a flat, folded-together position and simultaneously are placed in the plane formed by the legs so that, seen from the side, an L-shaped structure results which is composed of a vertical and a horizontal surface. In this position, the chair is still able to stand. The L shape makes it possible to nest the individual chairs in a space saving manner.

Preferably, rollers are attached to the lower end of the legs. These rollers permit movement of the folding chair or of a number of pushed-together folding chairs in the manner of a cart.

Preferably, the rearwardly oriented supporting arms are configured according to stackability principles. They thus converge approximately obliquely toward the rear and their upper surface drops toward the back. They may additionally be configured as a downwardly and inwardly open L-profile. In this way, the folded chairs can be pushed together in the manner encountered, for example, with retail shopping carts. In a tightly pushed-together state, the chairs can be tilted as a stack about the rollers of the first chair and can be pushed in the manner of a cart.

Preferably, the back rest is held by two upwardly angled supports which are rigidly connected with the rear ends of the arm rests and which may be connected with one another by a rearwardly curved bar. This bar may be employed as a handle when one or several folded chairs are moved.

The lower supporting arms are preferably connected with one another by a transverse brace at the rear end. Another transverse brace is provided in the lower end region of the legs but above the height of the rearwardly oriented supporting arms so that the above described pushing together is not impeded.

Furthermore, a locking device is preferably provided which locks the chairs in the folded position in an easily releasable manner. Devices may also be provided which laterally connect the chairs into a row of chairs.

BRIEF DESCRIPTION OF THE DRAWINGS

Preferred embodiments of the invention will now be described in greater detail with reference to the attached drawing figures.

DETAILED DESCRIPTION OF THE PREFERRED EMBODIMENT

Figure 1:
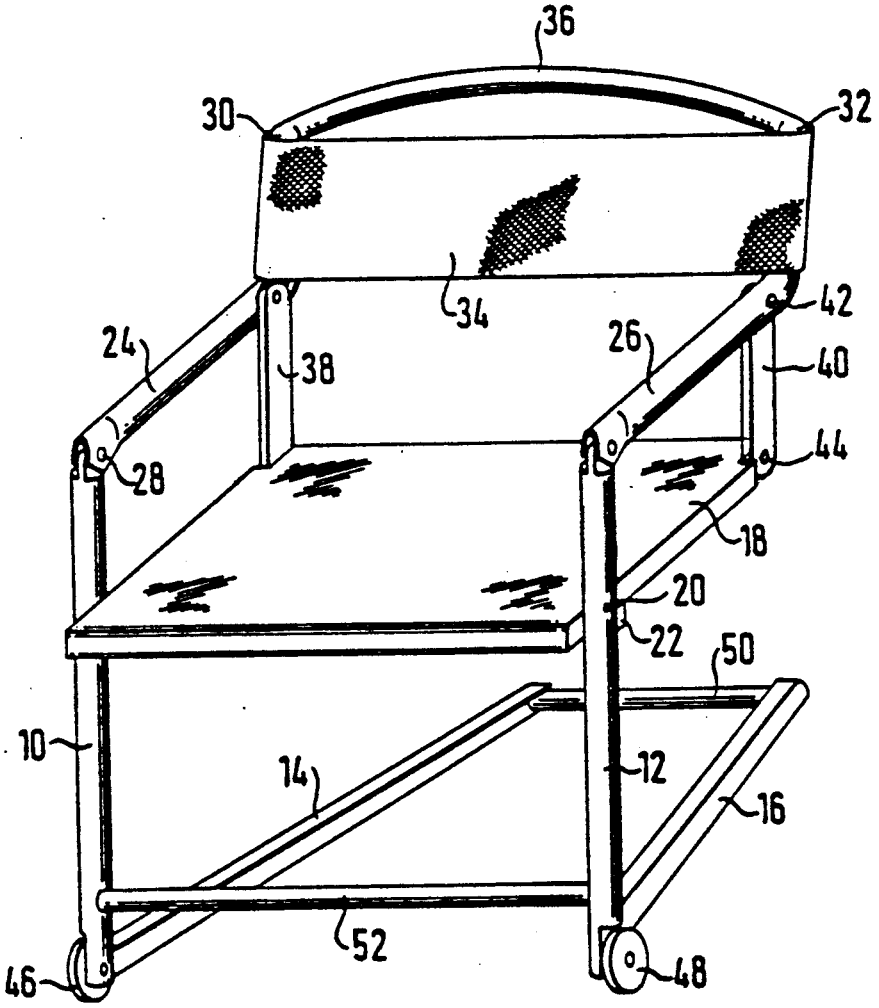
FIG. 1 is a perspective illustration of a chair according to the invention.

A chair according to the invention includes two front legs 10 and 12, with supporting arms 14 and 16 lying on the floor and extending rearwardly from the lower ends of the legs. The legs and supporting arms form a rigid, L-shaped unit. No rear legs are provided. By using a suitable elastic material, the chair is thus designed as a so-called free-swinging chair. At a distance from the upper end of legs 10 and 12, a seat plate 18 is suspended between them and is pivotal relative to the legs about a horizontal axis 20. The pivoting movement is limited downwardly to the essentially horizontal seating position of seat plate 18 by stops 22 at legs 10 and 12.

Arm rests 24 and 26 are attached to the upper end of legs 10 and 12 and are likewise pivotal about a common horizontal axis 28. At their rear ends, arm rests 24 and 26 extend obliquely upwardly to form bent supports 30 and 32 which accommodate a back rest 34. The upper ends of supports 30 and 32 are connected with one another by means of a rearwardly and/or upwardly curved bar 36.

Between the rear end of arm rests 24 and 26 or, more precisely, the region where supports 30 and 32 are attached, and the rear end of seat plate 18, essentially vertical struts 38 and 40 are provided on both sides; they are connected with the arm rests as well as with seat plate 18 so as to pivot about horizontal axes 42 and 44. Four horizontal axes 20, 28, 42 and 44 extend horizontally and transversely to the user of the chair and are thus parallel to one another.

Figure 3:
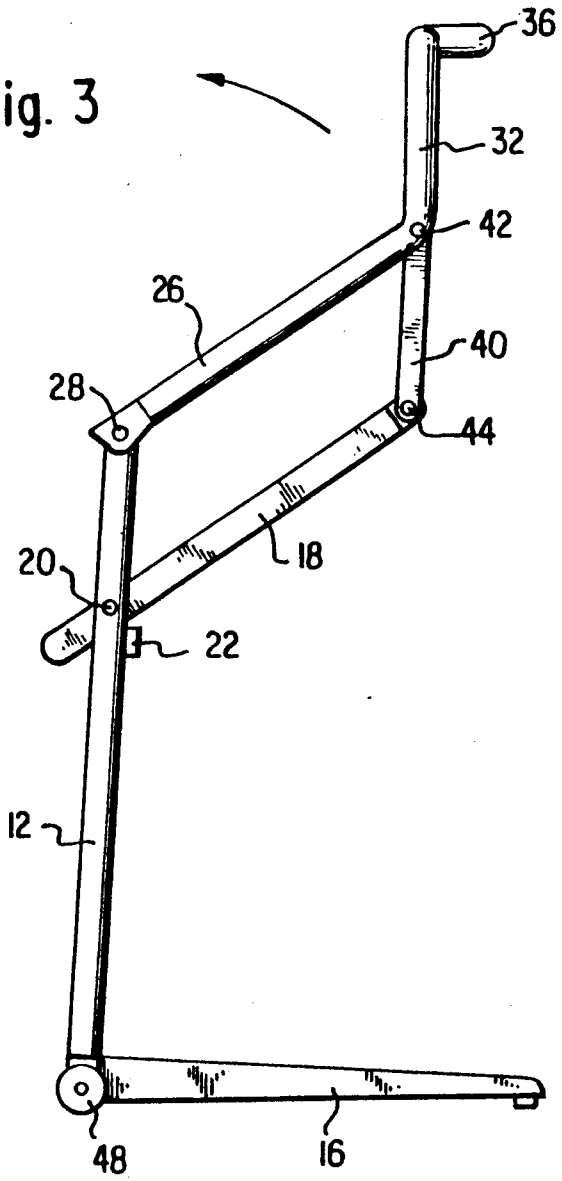
FIG. 3 is a side view of a chair according to the invention in the partially folded position.
Figure 2:
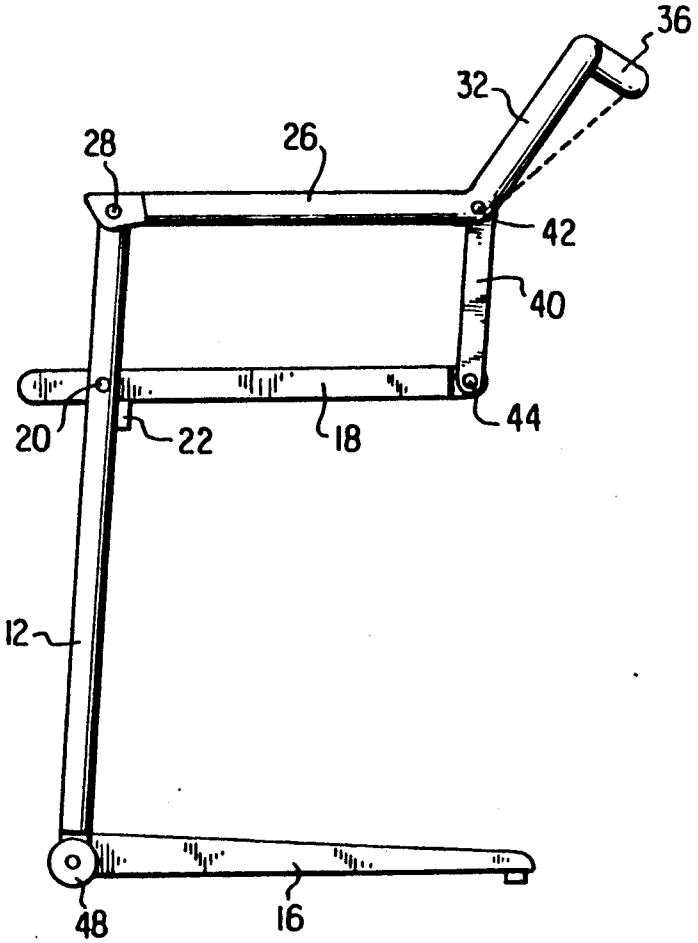
FIG. 2 is a side view of a chair according to the invention in the seating position.

A comparison between FIGS. 2 and 3 indicates that the upper end region of legs 10 and 12, arm rests 24 and 26, struts 38 and 40 and seat plate 18 form a parallelogram rod assembly on either side of the chair. When the chair is lifted at back rest 34 or at bar 36, this parallelogram rod assembly collapses in the manner indicated in FIG. 3.

Rollers 46 and 48 are provided on both sides at the lower ends of legs 10 and 12. If the chair is folded upwardly into the flat position and is locked in this position, it can be gripped at bar 36 and easily tilted forward to then be pushed in the manner of a cart.

Figure 4:
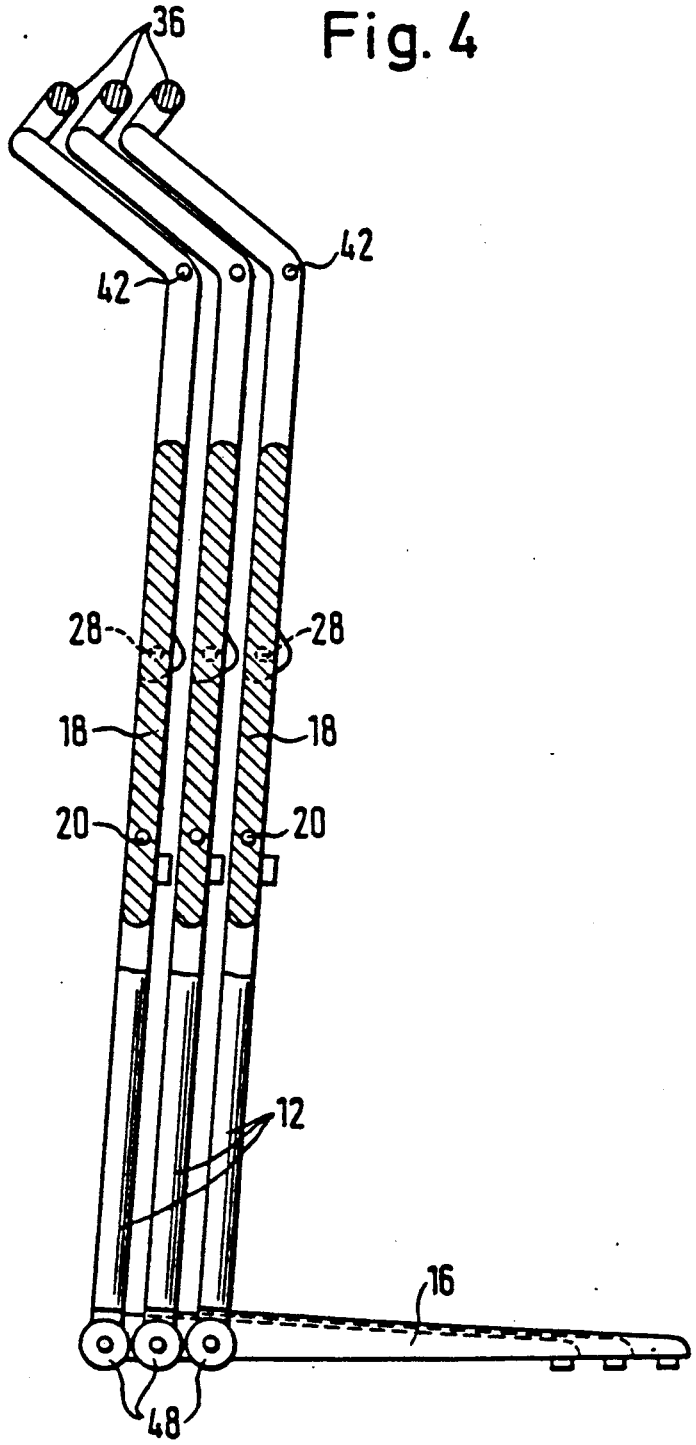
FIG. 4 shows a number of folded and pushed-together chairs according to the invention.

FIG. 4 shows that seat plate 18, arm rests 24 and 26 and struts 38 and 40 are pushed into a plane defined by legs 10 and 12 when the chair is folded so that a completely flat structure results. Moreover, according to FIG. 4, the lower supporting arms 14 and 16 are shaped and arranged in such a manner that they permit the pushing together and horizontal stacking of the base structures formed by supporting arms 14 and 16.

Initially, supporting arms 14 and 16 of FIG. 1 converge rearwardly at an acute angle. Additionally, the upper surface of supporting arms 14 and 16 is slightly sloped to the rear and finally, supporting arms 14 and 16 have an L-shaped cross section including a vertical outer flange and a horizontal upper flange. In this way, when folded, the supporting arms 14 and 16 of the next following chair always enclose supporting arms 14 and 16 of the preceding chair from the top and outside until they reach the minimum spacing shown in FIG. 4.

FIG. 1 shows that for stabilization supporting arms 14 and 16 are connected together at the rear end by means of a transverse brace 50. This transverse brace does not prevent the chairs from being pushed together since the respective following chair encloses from the outside and the top the base structure formed by supporting arms 14 and 16 and transverse brace 50. A front transverse brace 52 between the lower end regions of legs 10 and 12 lies above the upper surface of supporting arms 14 and 16 so that this transverse brace 52 passes over the supporting arms 14 and 16 of the preceding chairs when the chairs are pushed together.

Once several chairs have been pushed together as shown in FIG. 4, the stack of chairs can easily be tilted forward about rollers 46 and 48 and can be moved like a cart. One of bars 36 can then be used as a handle.

Generally, it will be advisable to provide detent devices for the seating position and/or the folded-up position to retain the chair in the respective position in such a manner that such devices can be released only by a greater use of force or by actuation of a release mechanism.

I claim:

1. A folding chair comprising:

two legs, each leg having a lower end and an upper end;

two supporting arms, each supporting arm being rigidly connected at its proximal end to the lower end of each leg;

two arm rests, each arm rest being pivotally connected at its proximal end to the upper end of each leg;

a seat supported by and pivotally connected to the two legs at a point on the legs lower than the arm rests;

two struts, each strut pivotally connecting the arm rest and an edge of the seat respectively attached to one leg at the end of the arm rest and edge of the seat distal from the leg, whereby one arm rest, one strut, one edge of the seat and the portion of the leg between the seat and the arm rest form a parallelogram assembly;

at least one stop positioned on one of the legs just below the pivotal connection of the seat to the leg, the stop thereby stopping the pivotal motion of the parallelogram assembly when the seat assumes the seating position; and a back rest disposed between and above the arm rests, whereby the chair folds by pulling the backrest upwardly until each side of the parallelogram assembly collapses into a single line.

2. A folding chair according to claim 1, further comprising two rollers each roller being attached to the lower end of the legs.

3. A folding chair according to claim 1, wherein the supporting arms converge obliquely toward the rear.

4. A folding chair according to claim 1, wherein an upper surface of the supporting arms is higher at its end proximal to the leg.

5. A folding chair according to claim 1, wherein the supporting arms have an L-shaped cross section; said cross section including an upper horizontal flange and an outer vertical flange.

6. A folding chair according to claim 1 wherein the back rest is held between two upwardly angled supports which are rigidly connected with the rear ends of the arm rests.

7. A folding chair according to claim 6, further comprising a rearward curved bar interconnecting the tops of the upwardly angled supports.

8. A folding chair according to claim 1, further comprising a transverse brace interconnecting the lower end of the legs above the supporting arms.

9. A folding chair according to claim 8, wherein the transverse brace is a first transverse brace and further comprising a second transverse brace interconnecting the supporting arms at their ends distal from the legs.

* * * * *